US005878311A

United States Patent [19]

Ichinokawa

[11] Patent Number: 5,878,311

[45] Date of Patent: Mar. 2, 1999

[54] OPTICAL MODULE

[75] Inventor: Kazuhiro Ichinokawa, Tokyo, Japan

[73] Assignee: Asahi Kogaku Kogyo Kabushiki Kaisha, Tokyo, Japan

[21] Appl. No.: 960,318

[22] Filed: Oct. 29, 1997

[30] Foreign Application Priority Data

Oct. 31, 1996 [JP] Japan ..... 8-305692

[51] Int. Cl.[6] ..... G03G 15/04

[52] U.S. Cl. ..... 399/118; 347/257; 399/177; 399/202

[58] Field of Search ..... 399/118, 177, 399/196, 202; 347/242, 241, 245, 256, 257, 263; 358/474, 496, 497; 206/316.1; 359/12

[56] References Cited

U.S. PATENT DOCUMENTS

| | | | |
|---|---|---|---|
| 4,891,669 | 1/1990 | Hiroki | 399/118 |
| 5,072,239 | 12/1991 | Mitcham et al. | 347/257 X |
| 5,751,431 | 5/1998 | Taka et al. | 399/118 X |

*Primary Examiner*—Arthur T. Grimley
*Assistant Examiner*—Sophia S. Chen
*Attorney, Agent, or Firm*—Greenblum & Bernstein, P.L.C.

[57] ABSTRACT

An optical module is intended to be assembled in an optical apparatus, and includes a chassis member having an opening therein. A mirror unit is provided in the opening of the chassis member, such that a lower part of the mirror unit protrudes from a lower surface of the chassis member, through the opening thereof. A protecting wall element, extending lower than the mirror unit, is formed along and suspended from at least a part of a periphery of the opening in order to physically protect the lower part of the mirror unit.

13 Claims, 8 Drawing Sheets

(COPYING-MAGNIFICATION : 1.0)

(COPYING-MAGNIFICATION : 2.0)

OPTICAL MODULE

BACKGROUND OF THE INVENTION

1. Field of the Invention

The present invention relates to a detachable optical module incorporated in an optical apparatus, such as an electrophotographic copier, and, more particularly, to a detachable optical module comprising a chassis on which various optical units are located, and which is detachably attached to a frame of the optical apparatus.

2. Description of the Related Art

As one type of optical module, an optical variable-magnification module for an electrophotographic copier is well known. This optical variable-magnification module comprises a rectangular chassis on which various optical units are located, and which is detachably attached to a frame of the electrophotographic copier. A movable mirror unit is known as a representative of the various optical units, and is provided on an upper surface of the chassis. Also, a movable focussing lens unit is known as another representative of the various optical units, and is provided on the upper surface of the chassis. Note, the movable focussing lens unit forms a part of an optical focussing system of the electrophotographic copier.

The movable mirror unit is operated in conjunction with the movable lens unit to vary a magnification of the optical focussing system of the electrophotographic copier. The movable mirror unit also serves to direct a light beam, passing through the movable focussing lens unit, to an area below the chassis of the optical module. To this end, the chassis has an opening formed therein, and the movable mirror unit is moved in the opening such that a lower portion of the movable mirror unit protrudes from the lower surface of the chassis, through the opening of the chassis.

In another type of optical module, an immovable mirror unit is provided in an opening of a chassis to direct a light beam from an upper side of the chassis to a lower side thereof, or vice versa. In this case, a lower portion of the immovable mirror unit protrudes from the lower surface of the chassis, through the opening thereof.

The optical module is independently manufactured and circulated. For example, the optical module is shipped to an optical apparatus manufacturer, such as an electrophotographic copier manufacturer, and is then incorporated into the optical apparatus as a preassembled unit. During shipping, the optical module is packed and protected.

Nevertheless, after the optical module is unpacked and is awaiting assembly in the optical apparatus, the optical module may be temporarily placed on a working table or a floor. In this case, the lower portion of the mirror unit, protruding from the lower surface of the chassis, may about against the working table or the floor, such that a detrimental force is exerted upon the mirror unit. When the lower portion of the mirror unit is subjected to the impact of placement, a positional readjustment of the mirror unit may occur or the mirror unit per se may be physically damaged.

Especially in regards to the optical variable magnification module for the electrophotographic copier, the movable mirror unit should be protected from impacts. This is because a positional relationship between the movable mirror unit and the movable focussing lens unit, in which the movable mirror unit is precisely extended perpendicularly to an optical axis of the movable focussing lens unit, has to be maintained before an image to be copied can be properly formed on a surface of a photosensitive drum.

In addition, in the electrophotographic copier having the optical variable-magnification module incorporated therein, while an object to be copied is illuminated with light emitted from a suitable light source, a part of the light emitted from the light source may, as stray light, become incident upon the movable mirror unit. Of course, when the stray light is directed to the photosensitive drum, the stray light appears as noise on a copied image.

SUMMARY OF THE INVENTION

Therefore, an object of the present invention is to provide an optical module comprising a chassis having an opening formed therein, and a mirror unit provided in the opening of the chassis such that a lower portion of the mirror unit protrudes from a lower surface of the chassis, through the opening thereof, wherein the chassis is constituted such that the lower portion of the mirror unit can be securely protected from physical impacts when the optical module is placed on a working table or a floor.

Another object of the present invention is to provide an optical variable-magnification module comprising a chassis having an opening formed therein, and a movable mirror unit provided in the opening of the chassis, such that a lower portion of the mirror unit protrudes from a lower surface of the chassis, through the opening thereof, wherein the chassis is constituted such that the movable mirror unit can be protected from stray light when the optical variable-magnification module is assembled in an optical apparatus, such as an electrophotographic copier.

Yet another object of the present invention is to provide a mirror unit located in the opening of the chassis, such that a lower portion of the mirror unit protrudes from a lower surface of the chassis, through the opening thereof, wherein the chassis is constituted such that the mirror unit can be protected from both physical impacts and stray light.

In accordance with a first aspect of the present invention, there is provided an optical module to be assembled in an optical apparatus, which comprises a chassis member having an opening therein, and a mirror unit provided in the opening of the chassis member, such that a lower part of the mirror unit protrudes from a lower surface of the chassis member through the opening thereof, wherein a protecting wall element, extending lower than a lowest point of the mirror unit, is formed along and suspended from at least a part of a periphery of the opening, in order to physically protect the lower part of the mirror unit.

The protecting wall element may also serve as a shield wall element for protecting the mirror unit from stray light after the optical module is assembled in the optical apparatus.

The mirror unit may be movably provided in the opening of the chassis member, and the opening is correspondingly extended in accordance with a movement range of the mirror unit. In this case, preferably, the protecting wall element or shield wall element is extended over the movement range of the mirror unit. Also, the protecting wall element or shield wall element may be integrally formed as a part of the chassis member. In this case, preferably, the opening of the chassis member is formed by punching, such that a part of the material of the chassis member, which is ordinarily removed, is left as a flap element. The protecting wall element is formed by bending the flap element along an edge of the opening.

In accordance with a second aspect of the present invention, there is provided an optical module to be assembled in an optical apparatus, which comprises a chassis member having an opening therein, and a mirror unit provided in the opening of the chassis member, such that a lower part of the mirror unit protrudes from a lower surface of the chassis member, through the opening thereof, wherein a shield wall element is formed along and suspended from at least a part of a periphery of the opening for protecting the lower part of the mirror unit from stray light, after the optical module is assembled in the optical apparatus.

In this second aspect, the mirror unit may also be movably provided in the opening of the chassis member, and the opening is correspondingly extended in accordance with a movement range of the mirror unit. In this case, preferably, the shield wall element is extended over the movement range of the mirror unit. Also, the shield wall element may be integrally formed as a part of the chassis member. In this case, preferably, the opening of the chassis member is formed by punching, such that a part of the material of the chassis member, which is ordinarily removed, is left as a flap element. The shield wall element is formed by bending the flap element along an edge of the opening.

In accordance with a third aspect of the present invention, there is provided an optical variable-magnification module to be assembled in an electrophotographic copier, which comprises a chassis member having an opening therein, and a movable mirror unit provided in the opening of the chassis member for varying a magnification of the copier, such that a lower part of the mirror unit protrudes from a lower surface of the chassis member, through the opening thereof, wherein a protecting wall element, extending lower than a lowest point of the movable mirror unit, is formed along and suspended from at least a part of a periphery of the opening, in order to physically protect the lower part of the movable mirror unit.

In the third aspect, the protecting wall element may also serve as a shield wall element for protecting the movable mirror unit from stray lights, emanating from an illumination of an object to be copied, after the optical module is assembled in the copier.

The opening of the chassis member is correspondingly extended in accordance with a movement range of the movable mirror unit. In this case, preferably, the shield wall element is extended over the movement range of the movable mirror unit.

The protecting wall element or shield wall element may be integrally formed as a part of the chassis member. In this case, preferably, the opening of the chassis member is formed by punching, such that a part of a material of the chassis member, which is ordinarily to be removed, is left as a flap element. The protecting wall element is formed by bending the flap element along an edge of the opening.

In accordance with a fourth aspect of the present invention, there is provided an optical variable-magnification module to be assembled in an electrophotographic copier, which comprises a chassis member having an opening therein, and a movable mirror unit provided in the opening of the chassis member, such that a lower part of the movable mirror unit protrudes from a lower surface of the chassis member, through the opening thereof, wherein a shield wall element is formed along and suspended from at least a part of a periphery of the opening, in order to protect the lower part of the movable mirror unit from stray light after the optical module is assembled in the copier.

In the fourth aspect, the opening of the chassis member is correspondingly extended in accordance with a movement range of the movable mirror unit. In this case, preferably, the shield wall element is extended over the movement range of the movable mirror unit. Also, the shield wall element may be integrally formed as a part of the chassis member. In this case, preferably, the opening of the chassis member is formed by punching such that a part of the material of the chassis, which is ordinarily removed, is left as a flap element. The shield wall element is formed by bending the flap element along an edge of the opening.

In accordance with a fifth aspect of the present invention, there is provided an optical module to be assembled in an optical apparatus, which comprises a chassis member, and a mirror unit provided on a lower surface of the chassis member, wherein a protecting wall element, extending lower than the mirror unit, is formed on and suspended from the lower surface of the chassis member so as to surround at least a part of the mirror unit.

BRIEF DESCRIPTION OF THE DRAWINGS

The objects and other objects of the present invention will be better understood from the following description, with reference to the accompanying drawings in which.

DESCRIPTION OF THE PREFERRED EMBODIMENTS

Figure 1:
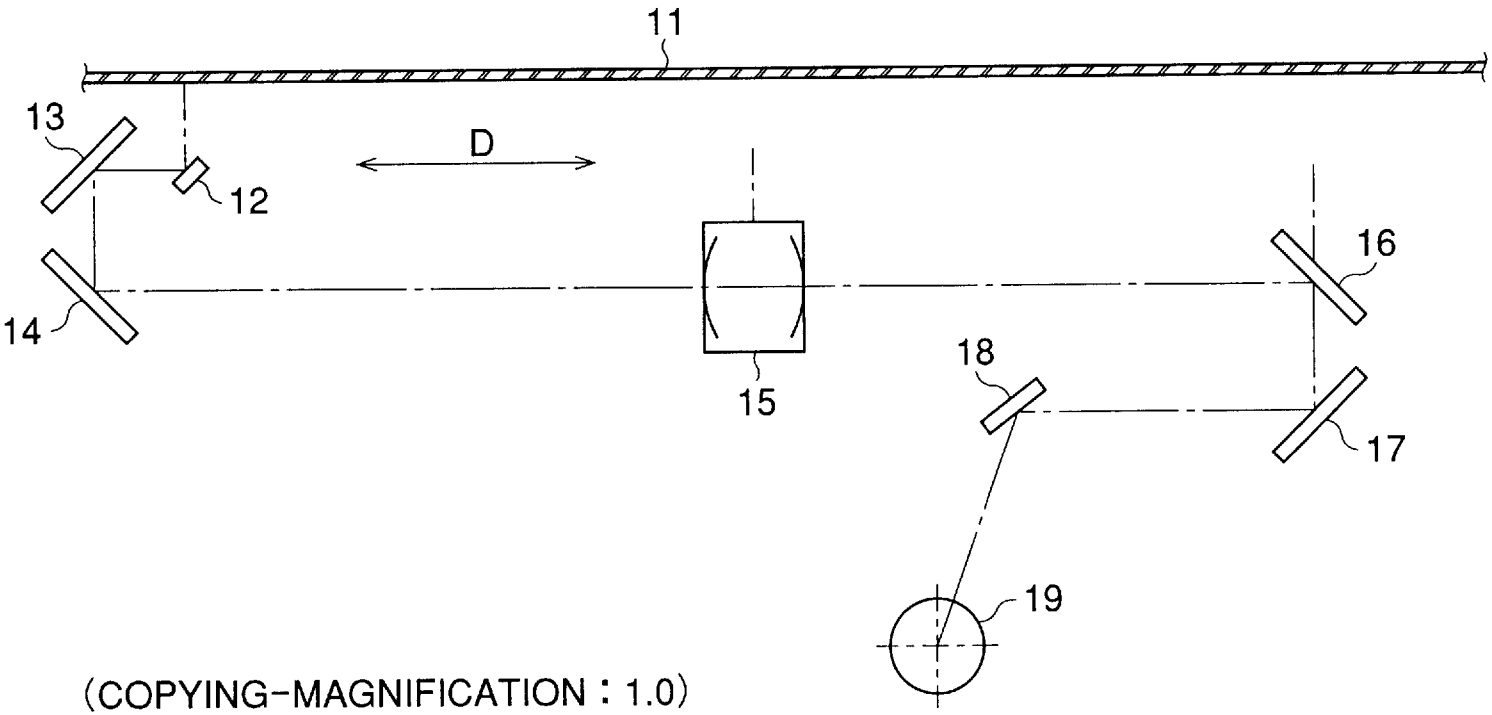
FIG. 1 is a schematic view showing an arrangement of main optical elements of an electrophotographic copier in which an optical variable-magnification module, according to the present invention, is incorporated.
Figure 2:
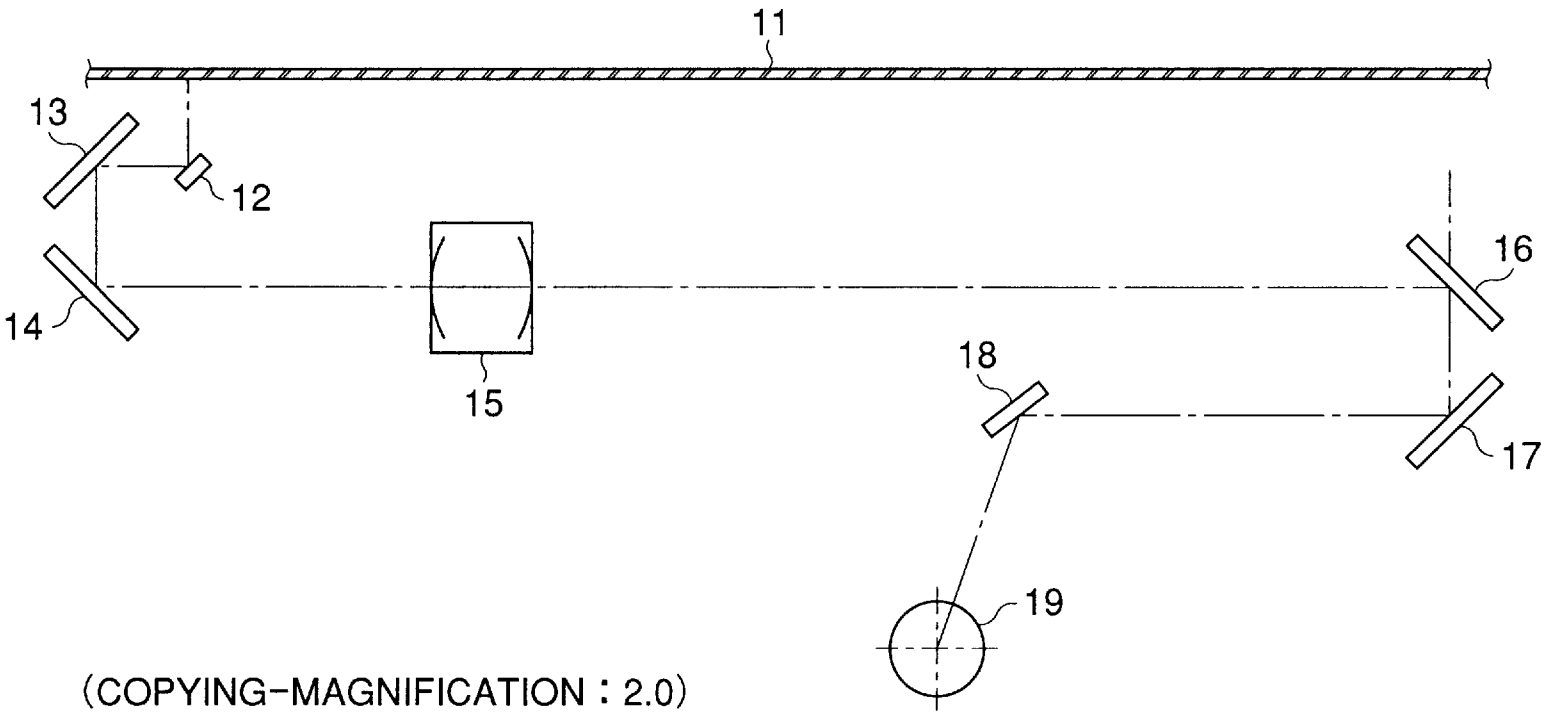
FIG. 2 is a schematic view similar to FIG. 1, but a movable lens unit and a movable mirror unit are shown at locations different from those shown in the FIG. 1.

With reference to FIGS. 1 and 2, an arrangement of the main optical elements of an electrophotographic copier is schematically shown. The electrophotographic copier comprises a transparent glass plate 11 defining a copying-surface, on which an object to be copied is placed. During a copying operation, the glass plate 11 is illuminated by a suitable light source (not shown). Light rays, reflected from the object, are directed to a focussing lens 15 via a first mirror 12, a second mirror 13 and a third mirror 14, and are then focussed, via the focussing lens 15, a fourth mirror 16, a fifth mirror 17 and a sixth mirror 18, onto a surface of a photosensitive drum 19, whereby an image of the object is formed on the surface of the photosensitive drum 19.

The focussing lens 15, and the fourth, fifth and sixth mirrors (16, 17 and 18, respectively) form a part of an optical variable-magnification module according to the present invention. The focussing lens 15 is movable in either one of the directions indicated by the double-headed arrow D shown in FIG. 1. The fourth and fifth mirrors 16 and 17 form a movable mirror unit, which is also moved in either one of the directions indicated by the arrow D.

A copying magnification of the image of the object, formed onto the photosensitive drum 19, can be varied by suitably and independently moving the focussing lens 15 and the movable mirror unit (16, 17) in either one of the directions of the arrow D. In the arrangement of the focussing lens 15 and the movable mirror unit (16, 17) shown in FIG. 1, the copying magnification is 1.0, and in the arrangement of the focussing lens 15 and the movable mirror (16, 17) shown in FIG. 2, the copying magnification is 2.0.

The first mirror 12 serves as a scanning mirror, and is movable in either one of the directions indicated by the arrow D. During the copying operation, the scanning mirror 12 is moved in only one of the directions of the arrow D, whereby the illuminated object is scanned with the scanning mirror 12. Similar to the fourth and fifth mirrors 16 and 17, both the second and third mirrors 13 and 14 form a movable mirror unit, which is movably supported in a suitable manner by a frame of the electrophotographic copier. While the illuminated object is scanned with the scanning mirror 12, the movable mirror unit (13, 14) is moved in the same direction as the scanning mirror 12, but a movement velocity of the first mirror unit (13, 14) is one-half of a movement velocity of the scanning mirror 12.

Note, of course, the mirrors 12, 13, 14, 16, 17 and 18 are of a suitable length to completely cover and extended over a width of the object placed on the glass plate 11.

With reference to FIGS. 3 to 6, a construction of the optical variable-magnification module according to the present invention is shown, which comprises a rectangular chassis 21 made of a suitable metal material. The chassis 21 may be shaped by pressing. The optical variable-magnification module also comprises a movable lens unit 22 slidably mounted on the chassis 21. The movable lens unit 22 includes an elongated box-like frame 22*a*, and the focussing lens 15 is securely mounted in the box-like frame 22*a* in such a manner that an optical axis of the focussing lens 15 is perpendicular to a longitudinal axis of the box-like frame 22*a*.

Figure 3:
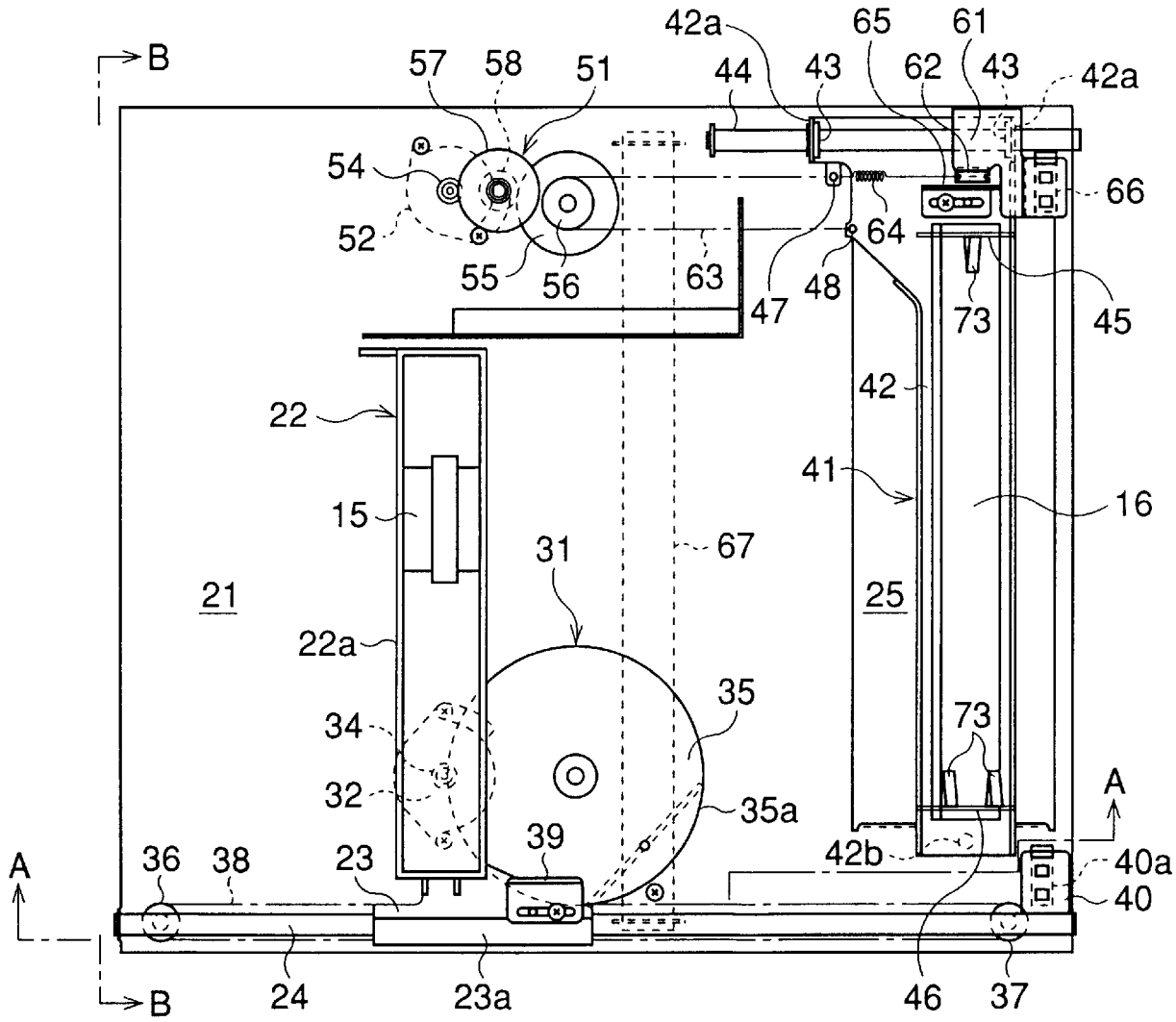
FIG. 3 is a plane view showing an embodiment of the optical variable-magnification module according to the present invention.

The box-like frame 22*a* has a bracket 23 securely attached to and extended from one end thereof. The bracket 23 has a sleeve 23*a* integrally formed therewith. The sleeve 23*a* is slidably passed over a first guide rod 24, which is arranged in parallel with the optical axis of the focussing lens 15 and along a side of the rectangular chassis 21, as shown in FIG. 3. Preferably, the sleeve 23*a* is formed of a suitable metal material, and has an inner low-frictional coat, such as polyacetal, formed over an inner surface thereof.

Figure 5:
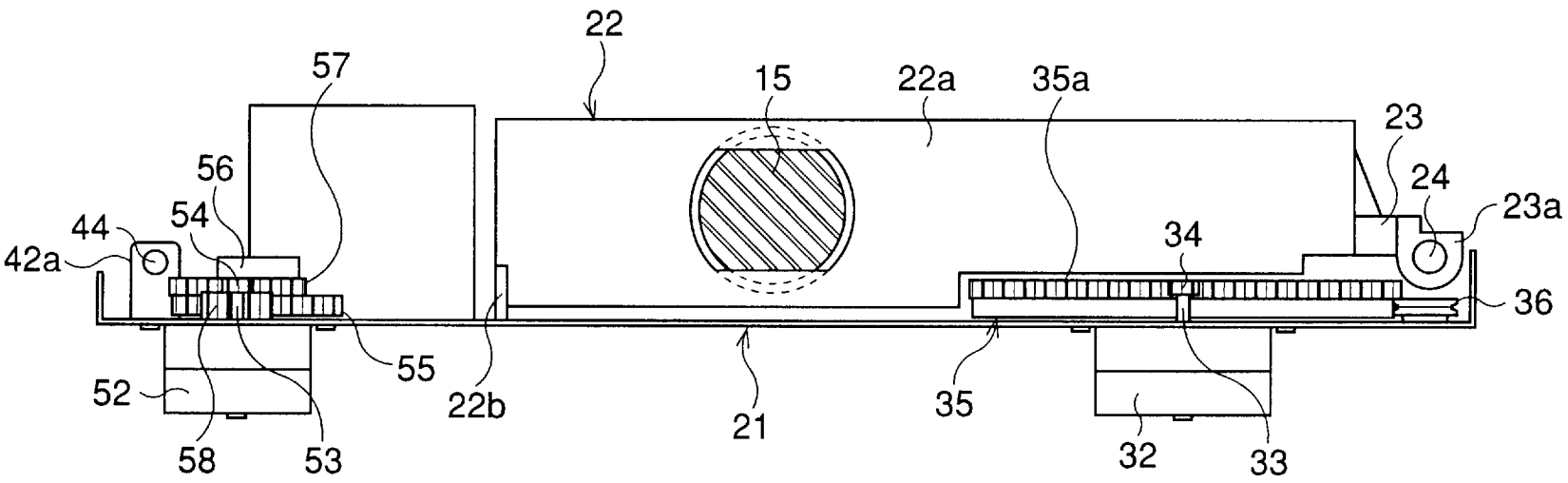
FIG. 5 is end view observed from line B—B of FIG. 3.

The box-like frame 22*a* also has a slide shoe element 22*b* attached to the other end thereof, as shown in FIG. 5, and the slide shoe element 22*b* may be formed of a suitable low-frictional material, such as polyacetal. Namely, the slide shoe element 22*b* bears the other end of the box-like frame 22*a* in such a manner that the movable lens unit 22 can be slidably moved along the first guide rod 24.

Figure 4:
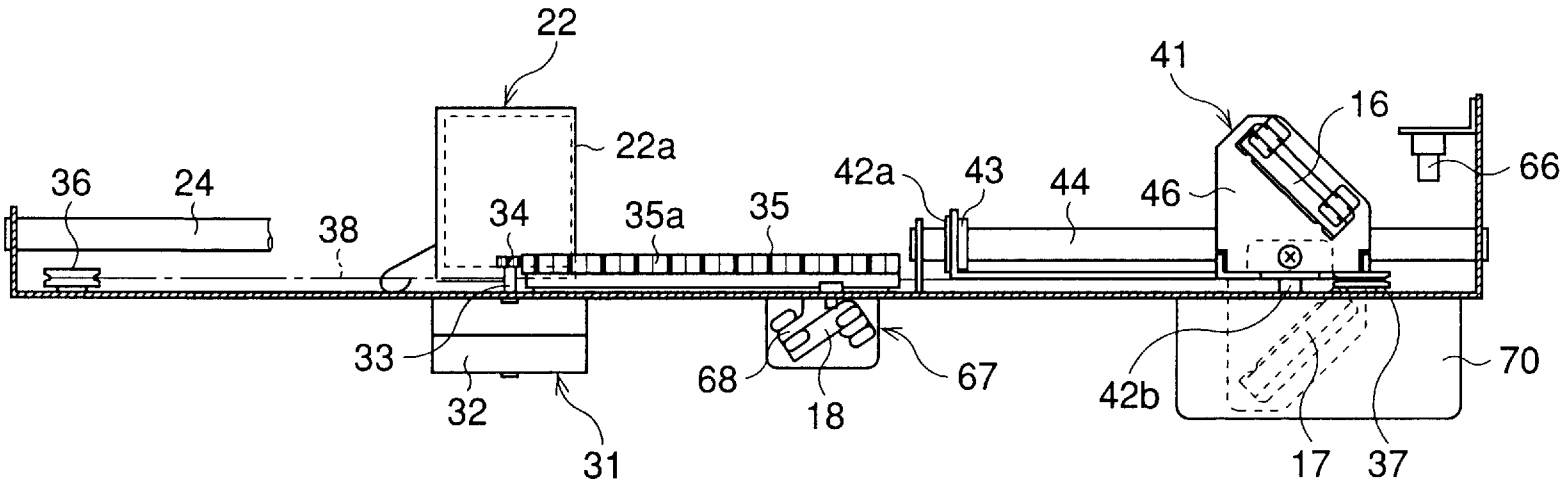
FIG. 4 is a sectional view taken along line A—A of FIG. 3.

The movement of the movable lens unit 22 is produced by a drive mechanism generally indicated by reference numeral 31. In particular, the drive mechanism 31 comprises a drive motor 32, such as a pulse motor, securely attached to a lower surface of the chassis 21. An output shaft 33 (FIGS. 4 and 5) of the drive motor 32 extends through the chassis 21, and has a gear 34 securely mounted thereon. The drive mechanism 31 also comprises a toothed pulley 35 having outer teeth 35*a* formed around an upper half area of the periphery thereof. The toothed pulley 35 is rotatably provided on an upper surface of the chassis 21. The outer teeth 35*a* of the toothed pulley 35 are meshed with the gear 34 of the drive motor 32, as best shown in FIG. 4. Note, as is apparent from FIGS. 4 and 5, a lower half area of the periphery of the toothed pulley 35 is smooth.

Further, the drive mechanism 31 comprises a pair of idle pulleys 36 and 37 rotatably provided on the upper surface of the chassis 21 and disposed in the vicinity of the ends of the first guide rod 24. A drive wire 38 is entrained by the peripheral smooth area of the toothed pulley 35 and by the idle pulleys 36 and 37, and is suitably connected to the bracket 23 of the box-like frame 22*a*.

With the arrangement as mentioned above, the movable lens unit 22 can be moved along the first guide rod 24, i.e. the optical axis of the focussing lens 15, by driving the drive motor 32. Of course, a direction of the movement of the movable lens unit 22 is dependent upon a rotational drive direction of the drive motor 32.

As shown in FIG. 3, a detection lug 39, provided on the bracket 23 of the box-like frame 22*a*, acts in conjunction with a photo-interrupter type sensor 40*a*, provided on a rear surface of a bracket 40. The bracket 40 is provided at the corner of the chassis 21 which is in the vicinity of the idle pulley 37, but is spaced away from the upper surface of the chassis 21. A home position or origin position of the movable lens unit 22 is defined by a position of the photo-interrupter type sensor 40*a*. Namely, when the movable lens unit 22 is moved to the home position, the drive motor 32 is stopped at he time when the photo-interrupter type sensor 40*a* detects he detection lug 39, thereby ensuring the halting of the movable lens unit 22 at the home position.

Figure 6:
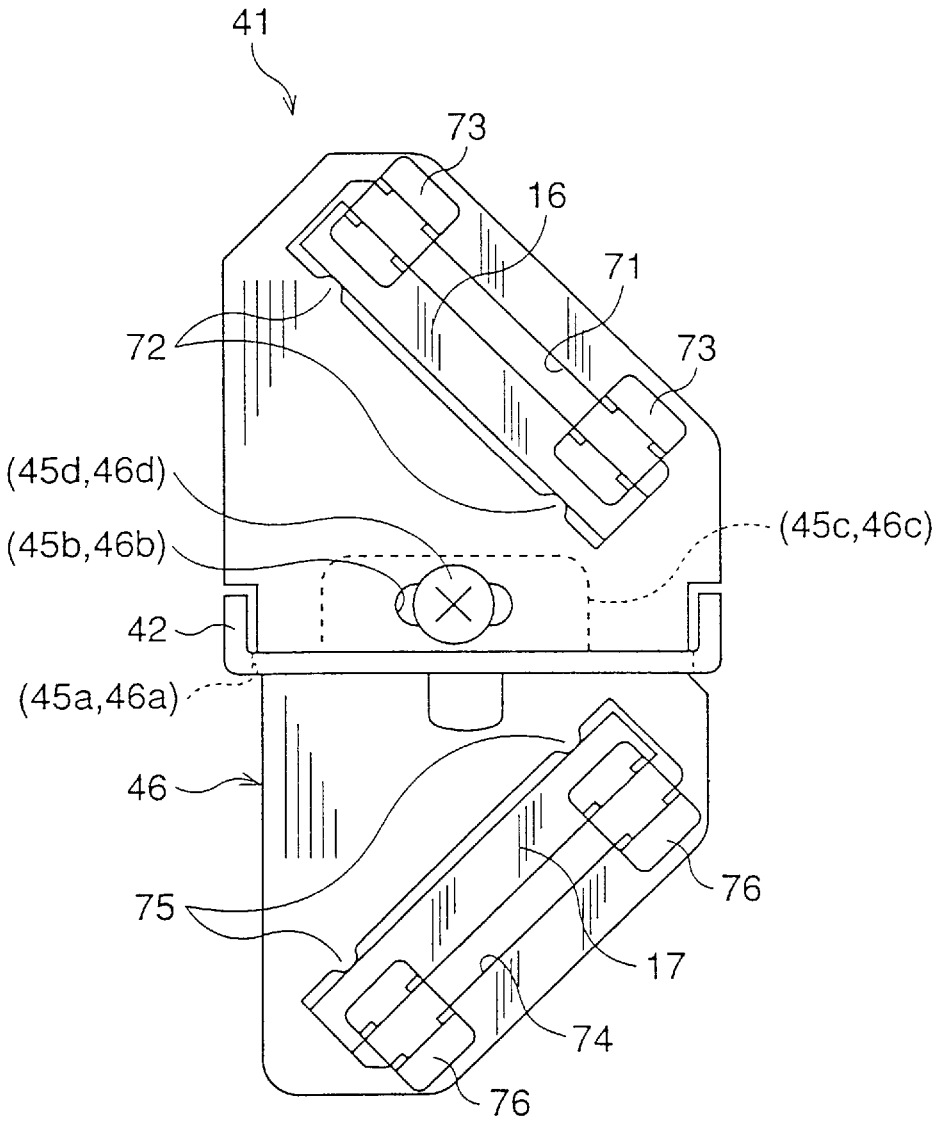
FIG. 6 is an enlarged end view of the movable mirror unit shown in FIG. 4.

As is apparent from the foregoing, the optical variable-magnification module, according to the present invention, comprises the movable mirror unit formed by the fourth and fifth mirrors 16 and 17 (FIGS. 1 and 2). In FIGS. 3, 4 and 6, the movable mirror unit concerned is indicated by reference numeral 41. The movable mirror unit 41, being slidably arranged on the upper surface of the chassis 21, includes a plate-like frame 42, extending in parallel with the box-like frame 22*a* of the movable lens unit 22, and a pair of vertical supporting plates 45 and 46 incorporated into the plate-like frame 42.

In particular, the vertical supporting plates 45 and 46 are identical to each other, and are inserted into slits 45*a* and 46*a* laterally formed in the plate-like frame 42 in the vicinity of the end portions thereof, as shown in FIG. 6. Each of the vertical supporting plates 45 and 46 has an oval slot 45*b*, 46*b* formed in a center area thereof, whereby the oval slots 45*b* and 46*b* are laterally extended with respect to the longitudinal axis of the plate-like frame 42. A flange element 45*c*, 46*c* is integrally formed along the corresponding slit 45*a*, 46*a*, and has a threaded hole formed therein. Each vertical supporting plate 45 and 46 is attached to the corresponding flange element 45*c*, 46*c* by engaging a screw 45*d*, 46*d* with the corresponding threaded hole.

As is apparent from FIG. 4, a lower portion of each vertical supporting plate 45, 46 extends downward through a generally-rectangular opening 25 (FIG. 3) formed in the chassis 21. The vertical supporting plates 45 and 46 are used to support the fourth and fifth mirrors 16 and 17.

In particular, as best shown in FIG. 6, an upper portion of each vertical supporting plate 45, 46 has an elongated slot 71 formed therein, and a longitudinal axis of the elongated slot 71 defines an angle of 45° with the lateral direction of the vertical supporting plates 45 and 46. Each end of the fourth mirror 16 is inserted into the corresponding slot 71 of the supporting plate 45, 46. The elongated slot 71 has a pair of positioning projections 72 protruding from a side edge defining the slot 71, and the mirror 16 is oriented in such a manner that the reflective surface thereof faces the positioning projections 72. Two wedge-shaped plate springs 73 are inserted into the space remaining at the rear side of the fourth mirror 16, so that the mirror 16 is resiliently pressed against the positioning projections 72, resulting in ensuring that the fourth mirror 16 can be properly positioned with respect to the vertical supporting plates 45 and 46.

Similarly, as shown in FIG. 6, the lower portion of each vertical supporting plate 45, 46 has an elongated slot 74 formed therein, and a longitudinal axis of the elongated slot 74 defines an angle of 45° with the lateral direction of the supporting plates 45 and 46 and an angle of 90° with the longitudinal axis of the elongated slot 71. Also, each end of the fifth mirror 17 is inserted into the corresponding slot 74 of the vertical supporting plate 45, 46. Further, the elongated slot 74 has a pair of positioning projections 75 protruding from a side edge defining the slot 74, in such a manner that the mirror 17 is oriented so that the reflective surface thereof faces the positioning projections 75. Two wedge-shaped plate springs 76 are inserted into the space remaining at the rear side of the fifth mirror 17, so that the mirror 17 is resiliently pressed against the positioning projections 75. Thus, the fifth mirror 17 can also be properly positioned with respect to the vertical supporting plates 45 and 46.

In assembling the movable mirror unit 41 in the chassis 21, the screws 45*d* and 46*d* are not completely tightened, so that the vertical supporting plates 45 and 46 possess moderate play with respect to the plate-like frame 42. After the assembly of the movable mirror unit 42 on the chassis 21, the vertical supporting plates 45 and 46 are minutely shifted with respect to the plate-like frame 42, so that the longitudinal axes of the mirrors 16 and 17 are extended perpendicularly to the optical axis of the focussing lens 15. Thereafter, screws 45*d* and 46*d* are completely tightened such that the vertical supporting plates 45 and 46 exhibit no play and are securely attached to the plate-like frame 42.

Although not visible, the plate-like frame 42 has an elongated opening formed therein, and the elongated opening is extended along the longitudinal axis of the plate-like frame 42. The light rays, reflected by the fourth mirror 16, are directed to the fifth mirror 17 through the elongated opening formed in the plate-like frame 42 and the opening 25 formed in the chassis 21.

An end portion of the plate-like frame 42 is extended in the length direction of the chassis 21, as shown in FIG. 3, and is integrally formed with a pair of ear elements 42*a* aligned with each other along the direction perpendicular to the longitudinal axis of the movable mirror unit 41. Each of the ear elements 42*a* has a through hole formed therein, and a slide ring element 43 is fitted around the circumference of the through hole of each ear element 42*a*. Note, the slide ring elements 43 may be formed of a sintered copper impregnated with a suitable lubricating oil.

The slide ring elements 43 of the ear elements 42*a* are slidably passed over a second guide rod 44, which is arranged in parallel with the optical axis of the focussing lens 15 and along the other side of the rectangular chassis 21, opposite to the side thereof along which the first guide rod 24 is arranged, as shown in FIG. 3.

The plate-like frame 42 also has a slide pad element 42*b* attached to the other end thereof, as best shown in FIG. 4, and the slide pad element 42*b* may be formed of a suitable low-frictional material, such as polyacetal. Namely, the slide pad element 42*b* bears the other end of the plate-like frame 42 in such a manner that the movable mirror unit 41 is slidably moved along the second guide rod 44.

The movement of the movable mirror unit 41 is produced by a drive mechanism generally indicated by reference numeral 51. The drive mechanism 51 comprises a drive motor 52, such as a pulse motor, securely attached to the lower surface of the chassis 21. As best shown in FIG. 5, an output shaft 53 of the drive motor 52 extends through the chassis 21, and has a gear 54 securely mounted thereon.

The drive mechanism 51 also comprises a double-gear member including a large gear portion 57 and a small gear portion 58 concentrically fixed to each other. The double-gear member is rotatably provided on the upper surface of the chassis 21 in the vicinity of the gear 54. The large gear portion 57 of the double-gear member meshes with the gear 54 of the drive motor 52.

Further, the drive mechanism 51 comprises a gear/pulley member including a gear 55 and a pulley 56 concentrically fixed to each other, and the gear/pulley member is rotatably provided on the upper surface of the chassis 21 in the vicinity of the double-gear. Note, as best shown in FIG. 3, the gear 55 has a diameter larger than that of the pulley 56. The gear 55 of the gear/pulley member meshes with the small gear portion 58 of the double-gear member.

Yet further, the drive mechanism 51 comprises a guide pulley 62 rotatably attached to a bracket 61, such that a rotational axis of the pulley 62 is perpendicular to the longitudinal axis of the second guide rod 44. Note, the bracket 61 is spaced away from the upper surface so that the bracket 61 does not interfere with the movement of the movable mirror unit 41. A drive wire 63 is entrained by the pulley 56 of the gear/pulley member and the guide pulley 62, and the ends of the drive wire 63 are connected to the plate-like frame 42. In particular, one end of the drive wire 63, via a coil spring 64, is connected to a tag element 47, protruding from the widely-extended end portion of the plate-like frame 42. Then, the drive wire 63 is threaded around the guide pulley 62, and is wound several times around the pulley 56 of the gear/pulley member. Thus, the other end of the drive wire 63 is connected to the widely-extended end portion of the plate-like frame 42 at a location indicated by reference numeral 48.

With the arrangement as mentioned above, the movable mirror unit 41 can be moved along the second guide rod 44, i.e. the optical axis of the focussing lens 15, by driving the drive motor 52. Of course, a direction of the movement of the movable mirror unit 41 is dependent upon a rotational drive direction of the drive motor 52, and the opening 25 has a sufficient size to allow the movement of the movable mirror unit 41.

As shown in FIG. 3, a detection lug 65, provided on the widely-extended end portion of the plate-like frame 42, acts 5 in conjunction with a photo-interrupter type sensor 66, which is provided on a rear surface of the bracket 61, to define a home position or origin position of the movable mirror unit 41. Namely, when the movable mirror unit 41 is moved to the home position, the detection lug 65 is detected by the photo-interrupter type sensor 66, thereby halting the drive motor 52 and ensuring the stopping of the movable mirror unit 41, at the home position, at the time of the detection of the detection lug 65 by the photo-interrupter type sensor 66.

The optical variable-magnification module, according to the present invention, further comprises a fixed mirror unit 67 securely attached to the lower surface of the chassis 21, and the fixed mirror unit 67 includes the above-mentioned sixth mirror 18. As best shown in FIG. 4, the fixed mirror unit 67 comprises an elongated frame 68 supported by the chassis 21, and the sixth mirror 18 is held by the elongated frame 68. The sixth mirror 18 is extended perpendicularly to the optical axis of the focussing lens 15 of the movable lens unit 22, and is inclined such that the light rays, received from the fifth mirror 17, are directed to the photosensitive drum 19 when the optical variable-magnification module is incorporated in the electro-photographic copier (FIGS. 1 and 2).

As is apparent from the forgoing, the movable mirror unit 41 has not only a function of varying a magnification of the focussing lens system (15), but also a function of conducting the light rays from the upper side of the chassis 21 to the lower side so as to direct the same to the fixed mirror unit 67. Thus, the lower portion of the movable mirror unit 41 necessarily protrudes from the lower surface of the chassis 21 through the rectangular opening 25.

Accordingly, when an optical variable-magnification module is temporarily placed on a working table or a floor during assembly of the module in the electrophotographic copier, the lower portion of the mirror unit, protruding from the lower surface of the chassis, may be abutted against the working table or the floor such that a detrimental force is exerted upon the mirror unit, resulting in a positional readjustment of the mirror unit or the mirror unit per se being physically damaged.

Nevertheless, according to the present invention, the chassis 21 is provided with a pair of protecting wall elements 70 suspended from opposite side edges of the rectangular opening 25, as shown in FIG. 4. Each of the protecting wall elements 70 extend lower than the lowest point of the movable mirror unit 41, protruding from the rectangular opening 25. Accordingly, if the optical variable-magnification module is temporarily placed on the working table or the floor, the protecting wall elements 70 merely abut against the surface of the working table or floor, thereby protecting the movable mirror unit 41 from an impact.

Further, after the movable mirror unit 41 is assembled in the electrophotographic copier, each of the protecting wall elements 70 serves as a shield wall element for protecting the movable mirror unit 41 from stray light resulting from an illumination of an object, to be copied, with light emitted from a suitable light source. In particular, in a copying-operation of the electrophotographic copier, the object to be copied is illuminated with light, a part of which may become incident upon the mirrors 16 and 17 as stray light. Nevertheless, the movable mirror unit 41 can be protected from the stray light due to the existence of the shield wall elements 70.

It is preferable to integrally form the protecting wall elements 70 with the chassis 21, as explained with reference to FIGS. 7 and 8 below.

Figure 7:
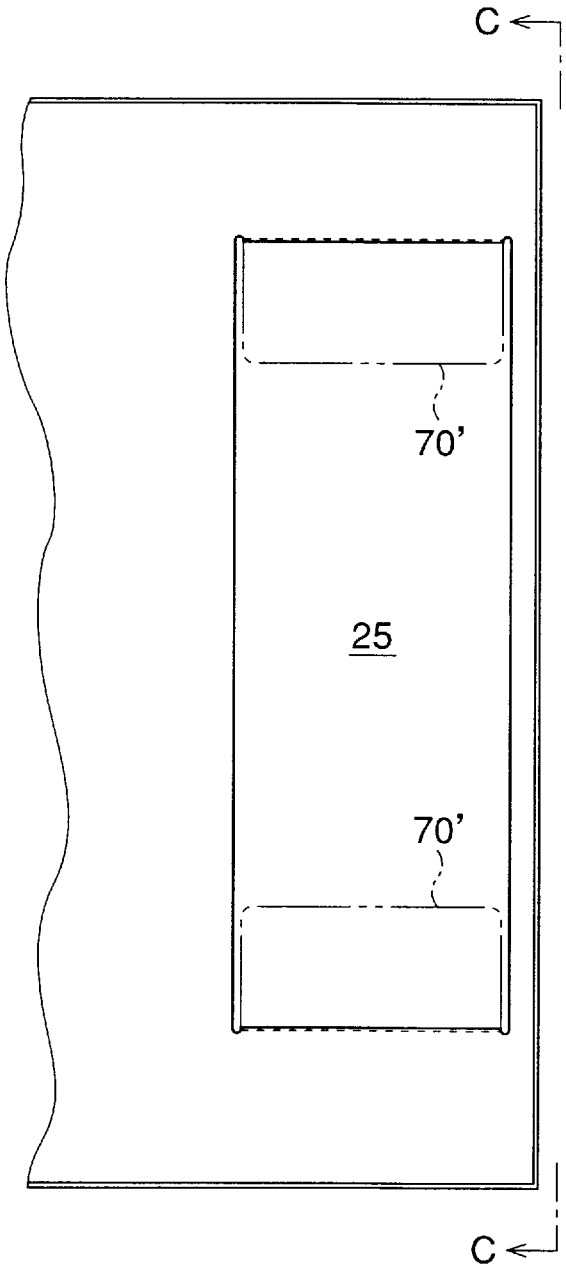
FIG. 7 is a partial plan view showing a product of an intermediate stage of production of a chassis of the optical variable-magnification module shown in FIG. 3.
Figure 8:
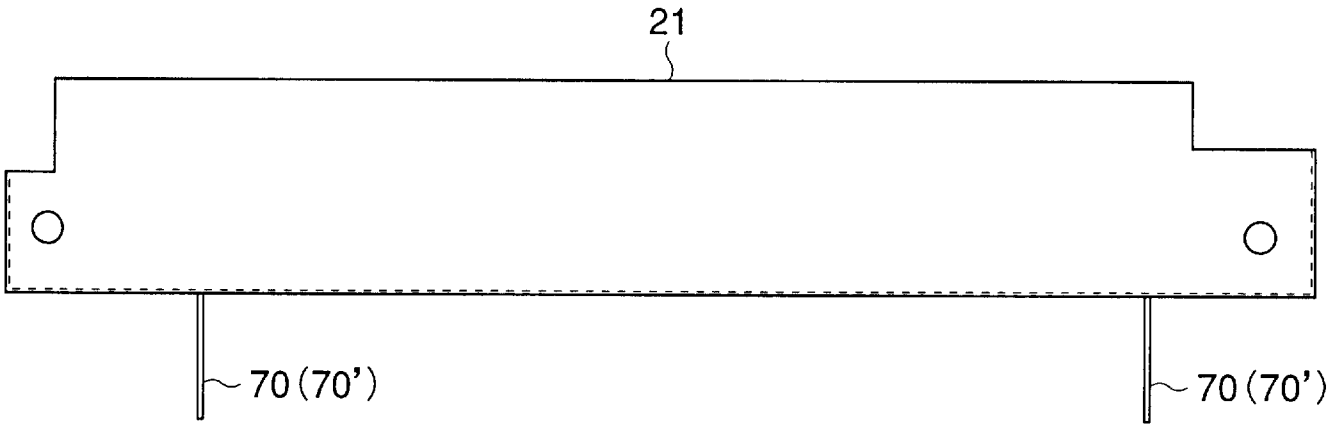
FIG. 8 is a side view observed taken along line C—C of FIG. 7.

FIG. 7 partly shows the product of an intermediate stage of production of the chassis 21, which is formed by pressing, except for the rectangular opening 25 which is formed by punching. Subsequent to the punching, the two opposed parts 70' of the material of the intermediate product, which is ordinarily removed, are left as flap elements along opposing edges of the opening 25. Then, the flap elements 70' are bent downward along the respective attached edges of the opening 25, to define a right angle with the horizontal area of the chassis 21, as best shown in FIG. 8. Thus, the bent flat elements 70' serve as the protecting wall elements 70.

Of course, each of the protecting wall elements 70 may be produced as an independent part, if necessary. In this case, the independent part is securely attached, as the protecting wall element 70, to the corresponding side edge of the rectangular opening 25 by, for example, welding or using suitable fittings, such as screws.

In the present invention, the protecting wall elements 70 may exhibit only one function of the shield wall elements for protecting the movable mirror unit 41 from the stray light. In this case, each of the shield wall elements 70 is not necessarily required to extend lower than a lowest point of the movable mirror unit 41, protruding from the rectangular opening 25.

In the above-mentioned embodiment, although the two protecting wall elements 70 are only provided along two opposing edges of the rectangular opening 25, a peripheral wall element may be suspended from a peripheral edge of the opening 25, or three or four protecting wall elements may be suspended from three or four side edges of the rectangular opening 25.

Although the above-mentioned embodiment is directed to the optical variable-magnification module for the electrophotographic copier, the present invention may be applied to another type of optical module having, for example, only immovable mirror units assembled therein.

Finally, it will be understood by those skilled in the art that the foregoing description is of a preferred embodiment of the optical module, and that various changes and modifications may be made to the present invention without departing from the spirit and scope thereof.

The present disclosure relates to subject matter contained in Japanese Patent Application No. 8-305692 (filed on Oct. 31, 1996), which is expressly incorporated herein, by reference, in its entirety.

I claim:

1. An optical module to be assembled in an optical apparatus, comprising:

a chassis member having an opening formed therein; and a mirror unit provided in said opening of said chassis member, such that a lower part of said mirror unit protrudes from a lower surface of said chassis member through said opening thereof, a protecting wall element, extending lower than said mirror unit, being formed along and suspended from at least a part of a periphery of said opening to physically protect said lower part of said mirror unit, said protecting wall element being integrally formed with said chassis member, wherein said opening of said chassis member is formed by punching, such that apart of a material of said chassis member, that is ordinarily removed, is left as a flap element, said protecting wall element being formed by bending said flap element along an edge of said opening.

2. An optical module to be assembled in an optical apparatus, comprising:

a chassis member having an opening formed therein; and a mirror unit provided in said opening of said chassis member, such that a lower part of said mirror unit protrudes from a lower surface of said chassis member through said opening thereof, a shield wall element being formed along and suspended from at least a part of a periphery of said opening for protecting said lower part of said mirror unit from stray light after said optical module is assembled in said optical apparatus, said mirror unit being movably provided in said opening of said chassis member, said opening extending in accordance with a movement range of said mirror unit, said shield wall element extending over a movement range of said mirror unit, wherein said opening of said chassis member is formed by punching, such that a part of a material of said chassis member, ordinarily removed, is left as a flap element, said shield wall element being formed by bending said flap element along an edge of said opening.

3. An optical variable-magnification module to be assembled in an electrophotographic copier, comprising:

a chassis member having an opening formed therein; and a movable mirror unit provided in said opening of said chassis member for varying a magnification of said copier, such that a lower part of said mirror unit protrudes from a lower surface of said chassis member through said opening thereof, wherein a protecting wall element, extending lower than said movable mirror unit, is formed along and suspended from at least a part of a periphery of said opening in order to physically protect said lower part of said movable mirror unit.

4. An optical variable-magnification module as set forth in claim 3, wherein said protecting wall element further serves as a shield wall element for protecting said movable mirror unit from stray light, derived from an illumination of an object to be copied, after said optical module is assembled in said copier.

5. An optical variable-magnification module as set forth in claim 4, wherein said shield wall element extends over a movement range of said movable mirror unit.

6. An optical variable-magnification module as set forth in claim 3, wherein said opening of said chassis member extends in accordance with a movement range of said movable mirror unit.

7. An optical variable-magnification module as set forth in claim 3, wherein said protecting wall element is integrally formed as a part of said chassis member.

8. An optical variable-magnification module as set forth in claim 7, wherein said opening of said chassis member is formed by punching, such that a part of a material of said chassis member, ordinarily removed, is left as a flap element, said protecting wall element being formed by bending said flap element along an edge of said opening.

9. An optical variable-magnification module to be assembled in an electrophotographic copier, comprising:

a chassis member having an opening formed therein; and a movable mirror unit provided in said opening of said chassis member, such that a lower part of said movable mirror unit protrudes from a lower surface of said chassis member through said opening thereof, wherein a shield wall element is formed along and suspended from at least a part of a periphery of said opening for protecting said lower part of said movable mirror unit from stray light after said optical module is assembled in said copier.

10. An optical variable-magnification module as set forth in claim 9, wherein said opening of said chassis member extends in accordance with a movement range of said movable mirror unit.

11. An optical variable-magnification module as set forth in claim 10, wherein said shield wall element extends over a movement range of said movable mirror unit.

12. An optical variable-magnification module as set forth in claim 9, wherein said shield wall element is integrally formed as a part of said chassis member.

13. An optical variable-magnification module as set forth in claim 12, wherein said opening of said chassis member is formed by punching, such that a part of a material of said chassis, ordinarily removed, is left as a flap element, said shield wall element being formed by bending said flap element along an edge of said opening.

* * * * *

UNITED STATES PATENT AND TRADEMARK OFFICE

CERTIFICATE OF CORRECTION

PATENT NO. : 5,878,311

DATED : March 2, 1999

INVENTOR(S) : K. ICHINOKAWA

It is certified that error appears in the above-identified patent and that said Letters Patent is hereby corrected as shown below:

At column 10, line 42 (claim 1, line 14) "apart" should be ---a part---.

Signed and Sealed this

Fourteenth Day of March, 2000

*Attest:*

Q. TODD DICKINSON

*Attesting Officer*

*Commissioner of Patents and Trademarks*